US008671786B2

(12) United States Patent
Notani

(10) Patent No.: US 8,671,786 B2
(45) Date of Patent: Mar. 18, 2014

(54) ENGINE STARTER CONTROL APPARATUS

(75) Inventor: Hideya Notani, Kariya (JP)

(73) Assignee: Denso Corporation, Kariya (JP)

( * ) Notice: Subject to any disclaimer, the term of this patent is extended or adjusted under 35 U.S.C. 154(b) by 229 days.

(21) Appl. No.: 13/028,724

(22) Filed: Feb. 16, 2011

(65) Prior Publication Data

US 2011/0203410 A1 Aug. 25, 2011

(30) Foreign Application Priority Data

Feb. 19, 2010 (JP) ..... 2010-034313

(51) Int. Cl.

| | |
|---|---|
| ***F02N 11/00*** | (2006.01) |
| ***F02N 15/00*** | (2006.01) |
| ***F02N 15/02*** | (2006.01) |
| ***F02N 15/04*** | (2006.01) |
| ***F02N 15/06*** | (2006.01) |

(52) U.S. Cl.
USPC ..... 74/7 R; 74/7 A; 123/179.25

(58) Field of Classification Search
USPC ..... 74/6, 7 A, 7 C, 7 R; 123/179.25, 179.1; 290/28, 38 R
See application file for complete search history.

(56) References Cited

U.S. PATENT DOCUMENTS

| | | | | |
|---|---|---|---|---|
| 1,414,653 | A * | 5/1922 | Kratz | 290/38 A |
| 3,177,368 | A * | 4/1965 | Seilly | 290/38 A |
| 5,012,686 | A * | 5/1991 | Morishita et al. | 74/7 A |
| 5,325,827 | A * | 7/1994 | Fasola | 123/179.3 |
| 7,275,509 | B2 * | 10/2007 | Kassner | 123/179.25 |
| 2007/0028880 | A1 | 2/2007 | Yuya et al. | |
| 2008/0162007 | A1 * | 7/2008 | Ishii et al. | 701/54 |
| 2010/0269630 | A1 * | 10/2010 | Niimi et al. | 74/7 |

FOREIGN PATENT DOCUMENTS

| | | |
|---|---|---|
| JP | A-2002-070699 | 3/2002 |
| JP | A-2005-330813 | 12/2005 |
| JP | A-2007-040263 | 2/2007 |
| JP | A-2008-163818 | 7/2008 |
| JP | A-2008-169802 | 7/2008 |

OTHER PUBLICATIONS

Jul. 23, 2013 Notification of Reasons for Rejection issued in Japanese Patent Application No. 2010-034313 (with translation).

* cited by examiner

*Primary Examiner* — Troy Chambers
*Assistant Examiner* — Jake Cook
(74) *Attorney, Agent, or Firm* — Oliff PLC

(57) ABSTRACT

A starter control apparatus is provided which is used with a starter equipped with a pinion engageable with a ring gear coupled to an output shaft of an engine and a motor operable to rotate the pinion to crank the engine. The starter control apparatus works to determine whether the engine has been placed to continue to run by itself after cranked by the motor or not. When such a condition is encountered, the starter control apparatus releases the engagement of the pinion with the ring gear while keeping the pinion rotated by the motor, thereby decreasing the torque exerted by the ring gear on the pinion to minimize the wear of the pinion.

5 Claims, 3 Drawing Sheets

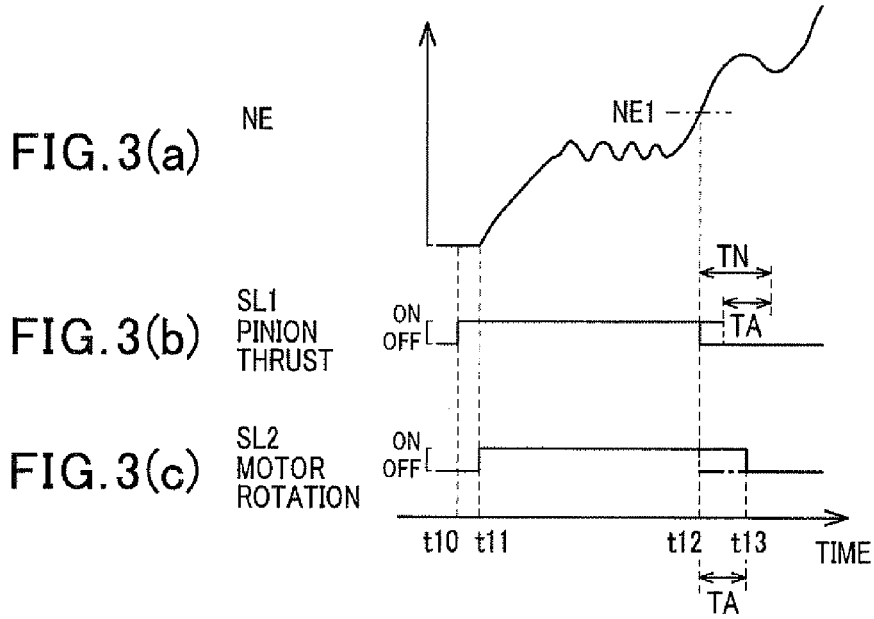
FIG.3(a)
NE
NE1
TN
FIG.3(b)
SL1
PINION
THRUST
ON
OFF
TA
FIG.3(c)
SL2
MOTOR
ROTATION
ON
OFF
t10
t11
t12
t13
TIME
TA
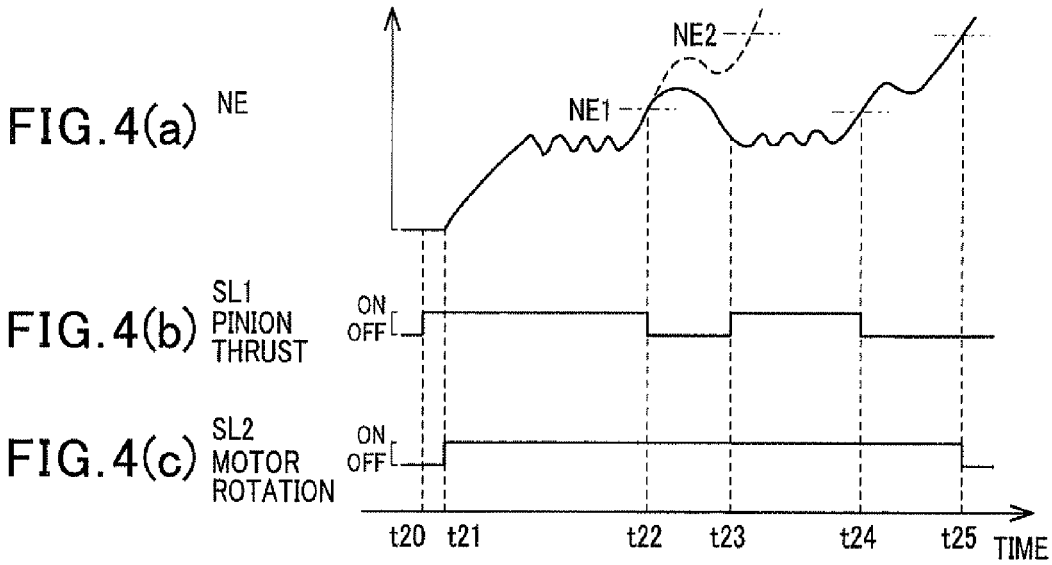
FIG.4(a)
NE
NE2
NE1
FIG.4(b)
SL1
PINION
THRUST
ON
OFF
FIG.4(c)
SL2
MOTOR
ROTATION
ON
OFF
t20
t21
t22
t23
t24
t25
TIME

ENGINE STARTER CONTROL APPARATUS

CROSS REFERENCE TO RELATED DOCUMENT

The present application claims the benefits of Japanese Patent Application No. 2010-34313 filed on Feb. 19, 2010, the disclosure of which is incorporated herein by reference.

BACKGROUND

1. Technical Field

The present invention relates generally to a controller for an engine starter which may be employed in automotive vehicles, and more particularly to such a controller designed to release engagement of a pinion of the starter with a ring gear of an engine after completion of cranking of the engine.

2. Background Art

In typical automotive vehicles, starting of an engine after being stopped is achieved by applying initial torque to an output shaft (i.e., a crankshaft) of the engine using a starter. Specifically, a starter controller energizes the starter to thrust a pinion in an axial direction thereof and bring it into engagement with a ring gear coupled mechanically to the crankshaft of the engine. The starter controller then energizes an electric motor installed in the starter to rotate the ring gear through the pinion to crank the engine. Upon completion of cranking of the engine, the starter controller deenergizes the starter to stop the rotation of the pinion. For example, Japanese Patent First Publication No. 2002-70699 discloses such a starter controller.

The starter, as taught in the above publication, is equipped with a first combination of a relay switch and a transistor for energizing or denergizing a solenoid to thrust the pinion and a second combination of a relay switch and a transistor for energizing or denergizing the electric motor. The starter controller controls times of the energization or deenergization in the first and second combinations to control the thrust of the pinion and the rotation of the motor separately. When the engine has been cranked by the motor and started, the starter controller stops energizing the motor and then disengages the starter from the engine.

In the case where the disengagement of the starter from the engine after completion of cranking of the engine is achieved by turning off the motor to stop the pinion and then release the engagement of the pinion with the ring gear, the pinion will be rotated by the ring gear without being driven by the motor until the pinion is disengaged from the ring gear actually after the motor is stopped. This leads to a greater concern about the mechanical wear of the pinion.

SUMMARY

It is therefore an object to provide an improved structure of a starter control apparatus designed to minimize the wear of parts of a starter.

According to one aspect of an embodiment, there is provided a starter control apparatus which is used in controlling an operation of a starter equipped with a pinion engageable with a ring gear coupled to an output shaft of an engine and a motor operable to rotate the pinion to crank the engine. The starter control apparatus comprises: (a) engine operating condition determining means for determining whether the engine has been placed in condition to continue to run by itself after cranked by the motor or not; and (b) engagement release means for releasing engagement of the pinion with the ring gear while keeping the pinion rotated by the motor when it is determined by the engine operating condition determining means that the engine has been placed to continue to run by itself.

Specifically, when it is required to disengage the starter from the engine after the engine starts to be cranked, the starter control apparatus releases the engagement of the pinion with the ring gear while keeping the pinion rotated by the motor. The pinion, therefore, continues to be rotated by the motor when the pinion is in mesh with the ring gear.

When the pinion is being rotated by the ring gear (e.g., the speed of the ring gear is higher than that of the motor), the magnitude of torque exerted by the ring gear on the pinion when the motor is in the on-state to produce torque is thought of as being smaller than that when the motor is in the off-state. This means that the mechanical wear of the pinion arising from being rotated by the ring gear will be small when the motor is running to exert the torque on the pinion. The starter control apparatus, as described above, keeps the motor rotating when the pinion is in engagement with the ring gear, thus resulting in a decrease in torque exerted by the ring gear on the pinion to minimize the wear of the pinion.

In the preferred mode of the embodiment, the starter control apparatus also comprises pinion rotation stop determining means for determining the time when rotation of the pinion is to be stopped based on a release-required time that is a period of time required between when the engagement release means instructs the starter to release the engagement of the pinion with the ring gear and when the release of the engagement of the pinion with the ring gear is completed actually. The release-required time usually changes with an individual variability or aging of the starter or a change in temperature of the starter. For instance, grease escapes from sliding parts of the starter or parts of the starter are worn away with the aging of the starter, which will result in an increase in the required period of time. Moreover, the lower the temperature of the starter, the higher the viscosity of the grease applied to the sliding parts of the starter, which results in an increase in the above release-required time.

In view of the above facts, the starter control apparatus works to determine the time when the rotation of the pinion is to be stopped based on the period of time consumed between when the engagement release means instructs the starter to release the engagement of the pinion with the ring gear and when the release of the engagement of the pinion with the ring gear is completed actually, thus keeping the pinion rotated by the motor for as long as possible when the pinion is in engagement with the ring gear, which minimizes the wear of the pinion. The motor is stopped at an optimum time selected based on the required period of time, thus enabling the length of time the motor is to be kept rotated to be minimized.

The starter control apparatus further comprises release completion determining means for determining whether the release of the engagement of the pinion with the ring gear has been completed or not after the engagement release means instructs the starter to release the engagement of the pinion with the ring gear and pinion rotation stop determining means for determining the time when the rotation of the pinion is to be stopped based a result of the determination of whether the release of the engagement of the pinion with the ring gear has been completed or not. This structure is operable to stop the rotation of the pinion through the motor after completion of the release of engagement of the pinion with the ring gear, thus minimizing the length of time the motor is to be kept rotated.

The starter may include a first solenoid, a first switch, a second solenoid, and a second switch. When turned on, the first solenoid brings the pinion into engagement with the ring gear. The first switch establishes an on-state and an off-state of the first solenoid selectively. The second solenoid works to open or close motor-energizing contacts to establish an off-state or an on-state of the motor. The second switch controls an operation of the second solenoid. The engagement release means switches the motor from the on-state to the off-state through the second switch to stop rotation of the pinion based on the time required between when the first solenoid is switched from the on-state to the off-state through the first switch and when release of the engagement of the pinion with the ring gear is completed.

Specifically, the starter works to establish the engagement or disengagement of the pinion with or from the pinion gear through the first solenoid and the first switch and also turn on or off the motor through the second solenoid and the second switch. The time required between when the starter control apparatus instructs the starter to disengage the pinion from the ring gear and when such disengagement is completed actually may be different from that required between when the starter control apparatus instructs the starter to stop the rotation of the pinion and when the rotation of the pinion is stopped actually.

The second solenoid is, as described above, designed to open or close the motor-energizing contacts to establish the off-state or the on-state of the motor, while the first solenoid is designed to move the pinion toward the ring gear or pull the pinion away from the ring gear to establish the engagement or the disengagement of the pinion with or from the ring gear. The movement of the pinion, therefore, requires the first solenoid to produce a greater degree of magnetic attraction than that produced by the second solenoid. The first solenoid, thus, needs to have a greater inductance as long as a common power supply is used for the first and second solenoids. This causes the electromotive force to be induced in the first solenoid when switched from the on-state to the off-state to release the engagement of the pinion with the ring gear to be greater than that induced in the second solenoid when switched from the on-state to the off-state to stop the motor, thus resulting in an increase in lag in pulling the pinion to disengage the pinion from the ring gear. The time required until completion of the release of the engagement of the pinion with the ring gear is, therefore, longer than that required until the motor is stopped. In view of this fact, the starter control apparatus stops the motor based on the lag in completing the disengagement of the pinion from the ring gear.

If the engine has failed to continue to run by itself due to a misfire of an air-fuel mixture after the disengagement of the pinion from the ring gear, but before the engine is fired up and starts to be run only by combustion of the mixture, the starter control apparatus is operable to bring the pinion into engagement with the ring gear to crank the engine again. In view of this fact, the starter control apparatus may be designed to have engine-fired up determining means for determining whether the engine has been fired up and started to run by itself or not after the engine starts to be cranked and pinion stop inhibiting means for inhibiting rotation of the pinion from being stopped until the engine-fired up determining means determines that the engine has been fired up and started to run by itself. This causes the pinion to be kept rotated for a period of time between the pinion is disengaged from the ring gear and when the engine is fired up, thereby enabling the engine to be restarted quickly.

In the discussion throughout this application, the fact that the engine has been fired up means that the engine has been placed to continue to run by itself.

The starter control apparatus may further comprise pinion stopping time determining means for determining a pinion stopping time that is the time when the motor is to be turned off to stop the rotation of the pinion. The engagement release means may release the engagement of the pinion with the ring gear before the pinion stopping time is reached. In the case where the starter is so designed that the pinion is disengaged from the ring gear after the motor is turned off to stop the rotation of the pinion, the pinion will be kept in engagement with the ring gear after the rotation of the pinion is stopped, thus resulting in an increased length of time the pinion is subjected to the rotation of the ring gear, which leads to a greater concern about the wear of rotating parts of the starter such as the pinion and a shaft of the pinion. The starter control apparatus, as described above, works to complete the disengagement of the pinion from the ring gear before the motor is stopped, thereby minimizing the length of time the pinion undergoes the rotation of the ring gear, that is, the wear of the rotating parts of the starter.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 3(*a*) represents the speed of an engine to be controlled by the engine stop/restart system of FIG. 1;

FIG. 3(*b*) represents an on/off state of a first solenoid installed in the engine stop/restart system of FIG. 1;

FIG. 3(*c*) represents an on/off state of a second solenoid installed in the engine stop/restart system of FIG. 1;

FIG. 4(*a*) represents the speed of an engine to be controlled by a modification of the engine stop/restart system of FIG. 1;

FIG. 4(*b*) represents an on/off state of a first solenoid installed in a modification of the engine stop/restart system of FIG. 1; and FIG. 4(*c*) represents an on/off state of a second solenoid installed in a modification of the engine stop/restart system of FIG. 1.

DESCRIPTION OF THE PREFERRED EMBODIMENTS

Figure 1:
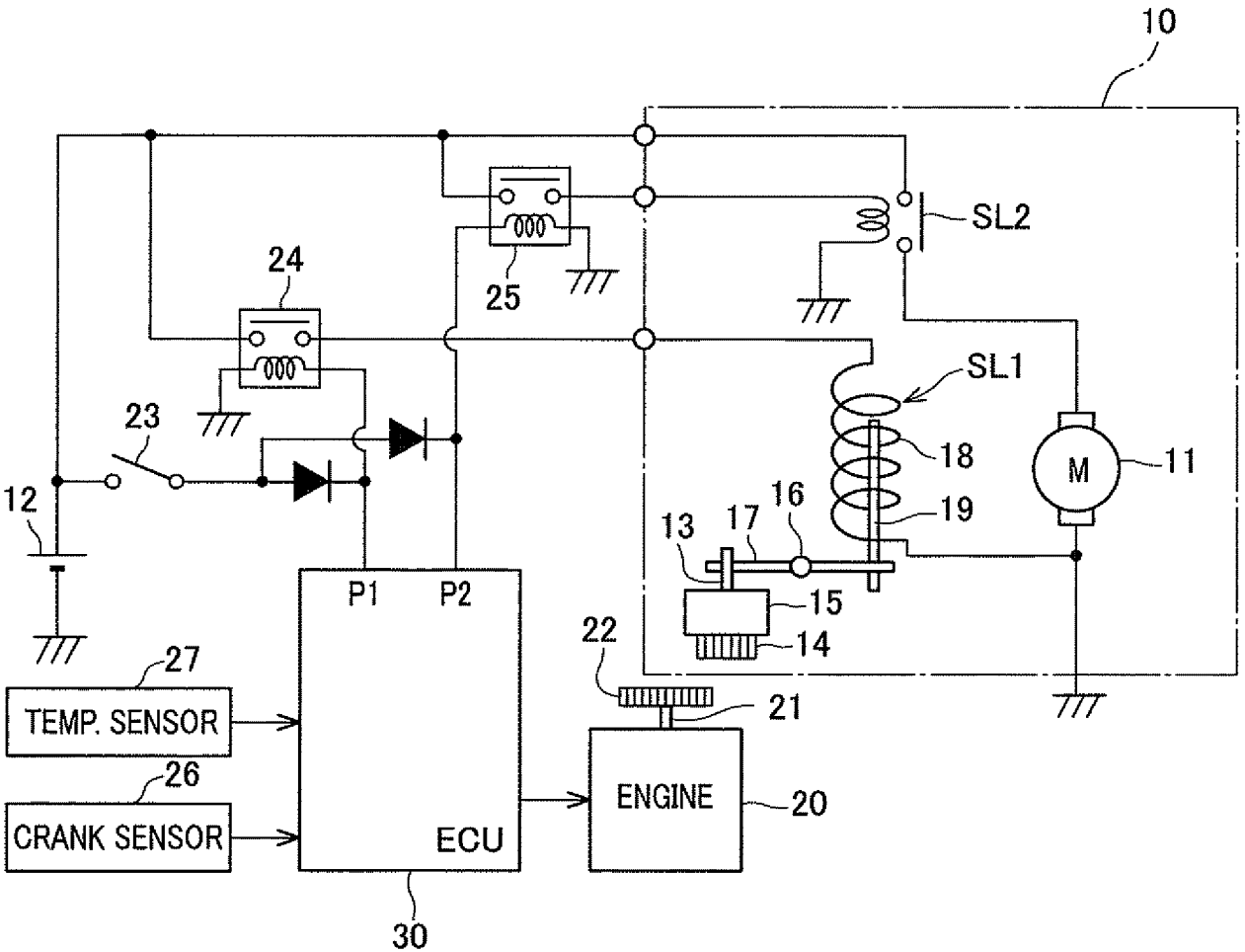
FIG. 1 is a block diagram which shows an automatic engine stop/restart system quipped with a starter control apparatus according to an embodiment of the invention.

Referring to the drawings, wherein like reference numbers refer to like parts in several views, particularly to FIG. 1, there is shown an engine starter controller which will be described as being embodied as an automatic engine stop/restart system designed to control stop and restart of an internal combustion engine 20 mounted in a motor vehicle automatically. The engine stop/restart system is equipped with an electronic control unit (ECU) 30 and works to control the quantity of fuel to be injected into the engine 20, the ignition timing of the fuel in the engine 20, and a stop/restart operation of the engine 20.

When it is required to start, stop, or restart the engine, the engine stop/restart system controls an operation of a starter 10. The starter 10 is equipped with an electric motor 11 which is to be rotated upon supply of electric power from a storage battery 12 installed in the vehicle. The electric motor 11 has an output shaft (not shown) on which a pinion shaft 13 is joined. The pinion shaft 13 retains at an end thereof a pinion 14 and a one-way clutch 15 which establishes or blocks transmission of torque between the pinion shaft 13 and the pinion 14 selectively.

The pinion shaft 13 is retained by an end of a lever 17 which is to be rotated about a shaft 16. To the other end of the lever 17, a first solenoid SL1 is joined which includes a coil 18 and a plunger 19. The plunger 19 is held by the lever 17 within the coil 18. When the coil 18 is in a deenergized state, the pinion 14 is placed away from a ring gear 22 coupled mechanically to an output shaft 21 (i.e., a crankshaft) of the engine 20. When the coil 18 is energized by the electric power from the battery 12, it will produce a magnetic attraction to move the plunger 19 in an axial direction thereof to rotate the lever 17 around the shaft 16. This causes the pinion 14 to be pushed to the ring gear 22 and then engage therewith.

When the coil 18 is deenergized in the condition where the pinion 14 is in mesh with the ring gear 22, it will cause the pinion shaft 13 to be moved by pressure, as produced by a spring (not shown), away from the ring gear 22, so that the pinion 14 is disengaged from the ring gear 22.

An ignition (IG) switch 23 is disposed between the battery 12 and the starter 10. When the ignition switch 23 is turned on manually by a vehicle operator, it permits the electric power to be supplied from the battery 12 to the starter 10. An SL1 drive relay 24 is disposed between the coil 18 and the battery 12. The SL1 drive relay 24 is responsive to a control signal from the ECU 30 to energize or deenergize the first solenoid SL1. A second solenoid SL2 is disposed between the motor 11 and the battery 12. The second solenoid SL2 has contacts which are connected electrically to an armature of the motor 11. An SL2 drive relay 25 is also disposed between the battery 12 and the motor 11. The SL2 drive relay 25 is responsive to a control signal from the ECU 30 to energize or deenergize the second solenoid SL2.

Specifically, the second solenoid SL2 works as a motor on/off switch to energize or deenergize the motor 11, while the first solenoid SL1 works as a pinion-push actuator to control the thrust or pull of the pinion 14 through movement of the plunger 19. The actuation of the motor 11 or the pinion 14, thus, requires the first solenoid SL1 to produce a greater magnitude of magnetic force than that to be produced by the second solenoid SL2. The first solenoid SL1 is, therefore, designed to have a greater inductance than that of the second solenoid SL2.

The engine stop/restart system also includes a crank angle sensor 26, a coolant temperature sensor 27, etc. The crank angel sensor 26 outputs to the ECU 30 a crank angle signal in the form of a pulse at a regular interval of a given crank angle (e.g., in cycle of 30° CA). The coolant temperature sensor 27 measures the temperature of coolant for the engine 20 and outputs a signal indicative thereof to the ECU 30.

An idle stop operation (also called engine stop/restart operation) made by the engine stop/restart system will be described below.

The idle stop operation is to stop the engine 20 automatically when a given engine stop condition is encountered while the engine 20 is running and then restart the engine 20 automatically when a given engine restart condition is met. For instance, the engine stop condition is determined as being encountered when a driver's effort on the accelerator pedal has become zero (0) to place the engine 20 in the idle mode, the brake pedal has been depressed, and/or the speed of the vehicle has dropped below a given value. The engine restart condition is determined as being met when the accelerator pedal has been depressed, the brake pedal has been released, and/or the state of charge of the battery 12 has dropped below a given lower level.

The ECU 30 is equipped with an output port P1 from which an on/off signal is outputted to the SL1 drive relay 24 and an output port P2 from which an on/off signal is outputted to the SL2 drive relay 25 in order to control the driving of the starter 10. The ECU 30 is operable to output the on/off signals to the SL1 and SL2 drive relays 24 and 25 to turn on or off the starter 10 automatically regardless of an operating state of a starter switch (not shown), in other words, energize or deenergize the motor 11 and the coil 18 independently from each other.

The operation of the starter 10 to crank the engine 20 will be described below.

First, action of the engine 20 when starting to be cranked will be explained. An example where the ignition switch 23 is turned on to start the engine 10 will be referred to below.

When the ignition switch 23 is turned on to request the starter 10 to start the engine 20, the ECU 30 first outputs the on-signal to the SL1 drive relay 24. The coil 18 is energized to push the pinion 14 to the ring gear 22 until the pinion 14 meshes with the ring gear 22. Subsequently, the ECU 30 outputs the on-signal to the SL2 drive relay 25 to energize the motor 11. The motor 11 produces torque to rotate the pinion 14. The rotation of the pinion 14 causes the ring gear 22 to rotate to crank the engine 20.

The operation of the starter 10 upon completion of cranking of the engine 20 using the starter 10 will be described below in detail.

When it is determined in the ECU 30 that a self-running condition where the engine 20 is placed to continue to run by itself has been encountered after the engine 20 is cranked by the starter 10, for example, when the speed NE1 of the engine 20 is determined as having reached 400 rpm to 500 rpm after the engine 20 is cranked, the ECU 30 stops the starter 10 to provide the initial torque to the engine 20.

When finishing the cranking of the engine 20, the ECU 30 releases the engagement of the pinion 14 with the ring gear 22 while rotating the pinion 14 through the motor 11. More specifically, the ECU 30 keeps the pinion 14 rotated by the motor 11, disengages the pinion 14 from the ring gear 22, and then turns off the motor 11 to stop the rotation of the pinion 14 after completion of the disengagement of the pinion 14 from the ring gear 22. This control keeps the pinion 14 rotated by the motor 11 for as long as possible when the pinion 14 is placed in mesh with the ring gear 22.

Specifically, when the engine 20 has been placed in the self-running condition, so that it has started to run by itself, and it is required to stop the cranking of the engine 20, the pinion 14 is thought of as undergoing the rotation of the ring gear 22 at a speed higher than that of the motor 11 to crank the engine 20. In such a condition, the magnitude of torque exerted by the ring gear 22 on the pinion 14 when the motor 11 is in the energized state to produce torque is thought of as being smaller than that when the motor 11 is in the deenergized state. This means that the mechanical wear of the pinion 14 arising from being rotated by the ring gear 22 will be smaller in the case where the motor 11 is kept running to produce the torque until the pinion 14 is disengaged from the ring gear 22. The ECU 30 is, therefore, engineered to release the engagement of the pinion 14 with the ring gear 22 while keeping the pinion 14 rotated by the motor 11, in other words, continue to rotate the pinion 14 through the motor 11 for as long as possible when the pinion 14 is in mesh with the ring gear 22, thereby minimizing the wear of the pinion 14.

The starter 10 of this embodiment is so designed as to consume the time from when it is instructed to release the engagement of the pinion 14 with the ring gear 22 until such release has been completed. The release of the engagement of the pinion 14 with the ring gear 22 will, therefore, be completed a certain period of time after the ECU 30 instructs the starter 10. Such release-required time is longer than the time required between when the ECU 20 instructs the motor 11 to stop and when the motor 11 actually stops.

The movement of the pinion 14 requires the first solenoid SL1 to produce a greater degree of magnetic attraction than that produced by the second solenoid SL2. The first solenoid SL1 is, therefore, designed to have a greater inductance. This causes the electromotive force to be induced in the first solenoid SL1 when switched from the on-state to the off-state to be greater than that to be induced in the second solenoid SL2 when switched from the on-state to the off-state, thus resulting in an increase in lag in pulling the pinion 14 away from the ring gear 22. In contrast, the second solenoid SL2 is, as described above, designed to open or close the contacts to deenergize or energize the motor 11 and thus not required to produce as a great degree of magnetic attraction as the first solenoid SL1 to actuate the motor 11. The second solenoid SL2 is, therefore, smaller in degree of the electromotive force induced when switched from the on-state to the off-state than the first solenoid SL1. The time lag in the action of the second solenoid SL2 upon switching from the on-state to the off-state to stop the motor 11 is not so great. Consequently, the release-required time TP that is a time interval from when the starter 10 is instructed to release the engagement of the pinion 14 with the ring gear 22, that is, the ECU 30 outputs the off-signal to the SL1 drive relay 24 until the engagement of the pinion 14 with the ring gear 22 is actually released is longer than a motor stop-required time that is a time interval from when the starter 10 is instructed to stop the motor 11, that is, the ECU 30 outputs the off-signal to the SL2 drive relay 25 until the motor 11 is actually stopped.

To keep the pinion 14 rotated by the motor 11 for as long as possible when the pinion 14 is in the engagement with the ring gear 22, it is preferable to turn off the motor 11 to stop rotating the pinion 14 after the ECU 30 instructs the starter 10 to release the engagement of the pinion 14 with the ring gear 22, and such release is actually completed.

The engine stop/restart system of this embodiment is, therefore, designed to determine the time when the second solenoid SL2 is to be turned off based on the release-required time TP. Specifically, the ECU 30 assumes that the motor stop-required time is very small and determines the time when the release-required time TP expires following turning off of the first solenoid SL1 as an off-time when the second solenoid SL2 is to be turned off. This will cause the motor 11 to be turned off to stop rotating the pinion 14 after completion of disengagement of the pinion 14 from the ring gear 22.

Figure 2:
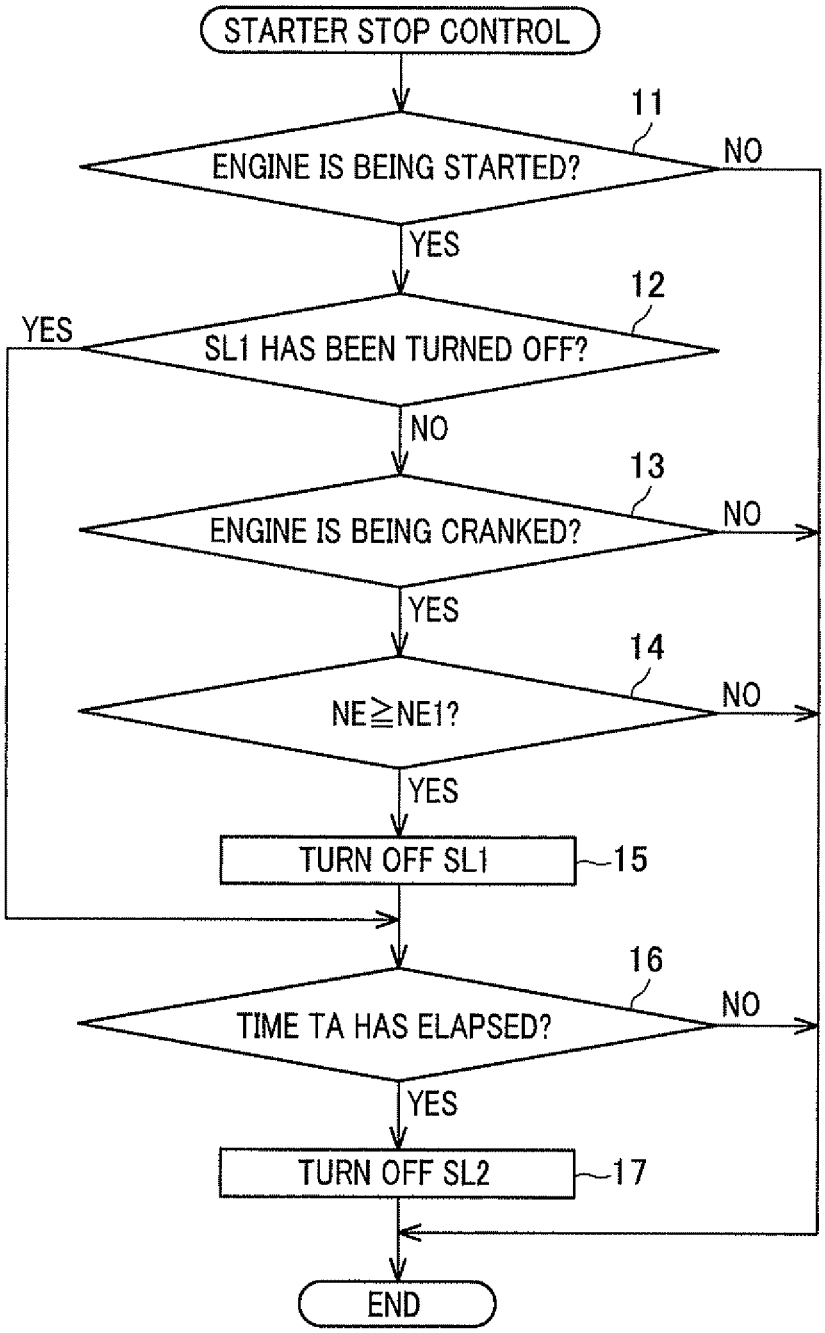
FIG. 2 is a flowchart of a starter stop control program to be executed by the engine stop/restart system of FIG. 1.

FIG. 2 is a flowchart of a sequence of steps or a starter stop control program to be executed by the ECU 30 at a given time interval to turn off the starter 10 upon completion of cranking of the engine 20.

After entering the program, the routine proceeds to step 11 wherein it is determined whether the engine 20 is now in a starting mode or not, in other words, whether the engine 20 is being cranked, but is not yet fired up or not. If a NO answer is obtained meaning that the engine 10 is not in the starting mode, then the routine terminates. Alternatively, if a YES answer is obtained meaning that the engine 10 is in the starting mode, then the routine proceeds to step 12 wherein it is determined whether the first solenoid SL1 has been switched from the on-state to the off-state in the starting mode or not, in other words, whether the engagement of the pinion 14 with the ring gear 22 is now being released or has been released. If the engine 20 is in an early stage of the starting mode, a NO answer is obtained in step 12. The routine then proceeds to step 13.

In step 13, it is determined whether the engine 20 is still being cranked by the starter 10 or not, that is, whether the first solenoid SL1 and the second solenoid SL2 are both in the on-state or not. If a YES answer is obtained meaning that the first solenoid SL1 and the second solenoid SL2 are both in the on-state, then the routine proceeds to step 14 wherein it is determined whether the speed NE of the engine 20, as measured by the crank angle sensor 26, is greater than or equal to a starting speed NE1 (e.g., 400 rpm to 500 rpm) or not. The starting speed NE1 is selected to be higher than the speed at which the motor 11 is to crank the engine 20 by a given value. If a NO answer is obtained meaning that the speed NE of the engine 20 is lower than the starting speed NE1, then the routine terminates. Alternatively, if a YES answer is obtained, then the routine proceeds to step 15.

In step 15, the SL1 drive relay 24 is turned off. Specifically, the ECU 30 outputs the off-signal to the SL1 drive relay 24 to switch the first solenoid SL1 from the on-state to the off-state. This causes the plunger 19 to be moved to pull the pinion shaft 13 away from the ring gear 22. In other words, the pinion shaft 13 is moved in a direction in which the pinion 14 is to be disengaged from the ring gear 22.

The routine then proceeds to step 16 wherein it is determined whether a given period of time TA (e.g., the release-required time TP or TP+a) has elapsed since the first solenoid SL1 was turned off or not. If a NO answer is obtained meaning that the period of time TA has not yet elapsed, then the routine terminates. Alternatively, if a YES answer is obtained meaning that the pinion 14 has been disengaged from the ring gear 22, then the routine proceeds to step 17 wherein the ECU 30 outputs the off-signal to the SL2 drive relay 25 to switch the second solenoid SL2 from the on-state to the off-state, so that the motor 11 is turned off to stop rotating the pinion 14.

FIGS. 3(*a*), 3(*b*), and 3(*c*) demonstrate a relation between the speed NE of the engine 20 and controlled operations of the first and second solenoids SL1 and SL2 when it is required to start the engine 20 and then stop the starter 10. Specifically, FIG. 3(*a*) represents the speed NE of the engine 20. FIG. 3(*b*) represents the on/off state of the first solenoid SL1. FIG. 3(*c*) represents the on/off state of the second solenoid SL2. A dashed line in each of FIGS. 3(*b*) and 3(*c*) demonstrates the case where the pinion 14 is disengaged from the ring gear 22 after the motor 11 is turned off.

When the ignition switch 23 has been switched from the on-state to the off-state, and the engine restart condition has been met after the engine 20 is stopped automatically at time t10, the ECU 30 outputs the on-signal to the SL1 drive relay 24 to energize the first solenoid SL1. The pinion 14 is then thrust to the ring gear 22. Afterwards, the ECU 30 outputs the on-signal to the SL2 drive relay 25 at time t11 to energize the second solenoid SL2. The motor 11 is then turned on to rotate the pinion 14, thereby providing the initial torque to the engine 20.

The engagement of the pinion 14 with the ring gear 22 is usually achieved at the moment when the pinion 14 is thrust to and reaches the ring gear 22 or when the pinion 14 reaches and hits the side surface of the ring gear 22 and is then rotated by the motor 11.

When the first ignition of fuel has occurred in the engine 20, and the speed NE of the engine 20 has been elevated above the starting speed NE1 at time t12, the ECU 30 determines that the engine 20 has been placed to continue to run by itself and outputs the off-signal to the SL1 drive relay 24 to deenergize the first solenoid SL1. This causes the pinion 14 to be pulled away from the ring gear 22, so that the pinion 14 is disengaged from the ring gear 22. At time t13 when the period of time TA has elapsed since time t12, the ECU 30 outputs the off-signal to the SL2 drive relay 25 to deenergize the second solenoid SL2, so that the motor 11 is stopped.

Typical engine starters are so designed that the thrust and rotation of the pinion are controlled electrically in conjunction with each other. Specifically, when the starter is energized, the pinion is first pushed toward the ring gear. Simultaneously, motor-energizing contacts are closed by the pushing of the pinion to actuate the motor. When the starter is deenergized, the motor-energizing contacts are first opened to stop the motor. Afterwards, the pinion is moved away from the ring gear. The engagement of the pinion with the ring gear is, therefore, released after the stop of the motor.

The case where the first solenoid SL1 is turned off, unlike this embodiment, after the second solenoid SL2 is turned off will be considered below. For example, the second solenoid SL2 is turned off at time t12 to stop the motor 11. Subsequently, the first solenoid SL1 is turned off, so that the pinion 14 is moved out of engagement with the ring gear 22 after the elapse of the period of time TA. Consequently, the pinion 14 is, like in the conventional starters, rotated by the rotation of the ring gear 22 for a period of time TN after time t12 when the motor 11 is in the off-state. This causes a greater degree of torque to be exerted by the ring gear 22 on the pinion 14 for the period of time TN. In contrast, the engine stop/restart system of this embodiment is engineered to rotate the pinion 14 through the motor 11 for the period of time TN during which the pinion 14 is subjected to the torque of the ring gear 22, thereby minimizing the wear of the pinion 14.

The beneficial effects of this embodiment will be described below.

When it is required to disengage the starter 10 from the engine 20 to terminate the cranking of the engine 20 through the starter 10, the engine stop/restart system releases the engagement of the pinion 14 with the ring gear 22 while rotating the pinion 14 through the motor 11. This keeps the pinion 14 rotated by the motor 11 for a long period when the pinion 14 is placed in engagement with the ring gear 22. Therefore, when the speed of the ring gear 22 becomes higher than that of the pinion 14 upon completion of cranking of the engine 20, and the pinion 14 is rotated by the ring gear 22, the torque exerted by the ring gear 22 on the pinion 14 will be smaller in magnitude than in the conventional starters, thus resulting in a decrease in wear of the pinion 14.

The ECU 30 is designed to determine the time when the motor 11 is to be stopped as a function of a time lag between when the ECU 30 instructs the starter 10 to disengage the pinion 14 from the ring gear 22 and when such disengagement is completed actually, that is, to instruct the starter 10 to disengage the pinion 14 from the ring gear 22 and then turn off the motor 11 after the lapse of a desired time for which the pinion 14 is to be kept in engagement with the ring gear 22. This keeps the pinion 14 rotated by the motor 11 when the pinion 14 is placed in engagement with the ring gear 22, thus minimizing the wear of the pinion 14. The motor 11 is, as described above, turned off based on the above time lag, thereby enabling the length of time the motor 11 is to be kept rotated to be minimized.

Specifically, the ECU 30 outputs the off-signal to the SL2 drive relay 25 to stop the motor 11 after the lapse of the release-required time TP from the time when the ECU 30 instructs the starter 10 to disengage the pinion 14 from the ring gear 22, that is, outputs the off-signal to the SL1 drive relay 24, thereby keeping the pinion 14 rotated by the motor 11 for a period of time between when the ECU 30 instructs the starter 10 to disengage the pinion 14 from the ring gear 22 and when such disengagement is completed actually. This minimizes the wear of the pinion 14 further.

In the engine stop/restart system designed to establish or release the engagement of the pinion 14 with the ring gear 22 through the first solenoid SL1 and the SL1 drive relay 24 and to control the stop or start of the motor 11 through the second solenoid SL2 and the SL2 drive relay 25, the time required between when the ECU 30 instructs the starter 10 to disengage the pinion 14 from the ring gear 22 and when such disengagement is completed actually will be longer than the time required between when the ECU 30 instructs the starter 10 to stop the motor 11 and when the motor 11 is stopped actually due to a difference in inductance between the first and second solenoid SL1 and SL2. The engine stop/restart system of this embodiment is operable to keep the pinion 14 rotated by the motor 11 for a period of time between when the ECU 30 instructs the starter 10 to release the engagement of the pinion 14 with the ring gear 22 and when such release is completed actually, thereby minimizing the torque acting on the pinion 14 until the pinion 14 is disengaged from the ring gear 22 and decreasing the wear of the pinion 14 further.

The engine stop/restart system of the above embodiment may be modified as discussed below.

The ECU 30 determines the time when the rotation of the pinion 14 is to be stopped based on the release-required time TP that is the time required between when the ECU 30 instructs the starter 10 to disengage the pinion 14 from the ring gear 22 and when such disengagement is completed actually. Specifically, the ECU 30 turns off the second solenoid SL2 after the lapse of the period of time TA since the first solenoid SL1 was turned off and changes the period of time TA in view of facts as discussed below.

Usually, the lower the temperature of the starter 10, the higher the viscosity of grease applied to sliding parts of the starter 10. The grease also escapes from the sliding parts of the starter 10, or parts of the starter 10 are worn away with the aging of the starter 10. This will result in an increase in the release-required time TP that is the time required between when the ECU 30 instructs the starter 10 to disengage the pinion 14 from the ring gear 22 and when such disengagement is completed actually. The ECU 33, therefore, changes the period of time TA or determine the time when the motor 11 is to be turned off to stop the pinion 14 based on the temperature or the degree of aging of the starter 10. This ensures the stability in keeping the pinion 14 rotated by the motor 11 for as long as possible when the pinion 14 is placed in engagement with the ring gear 22, thus minimizing the wear of the pinion 14.

The temperature of the starter 10 may be calculated as a function of the temperature of coolant, as measured by the coolant temperature sensor 27, or determined directly by installing a temperature sensor on the starter 10 and sampling an output therefrom. The aging of the starter 10 may be determined by counting a total number of time the engine 20 has been started by the starter 10 or based on the time elapsed since the starter 10 was shipped from the factory.

The engine stop/restart system may be designed to have means for monitoring whether the release of engagement of the pinion 14 with the ring gear 22 has been completed or not and determine the time when the rotation of the pinion 14 is to be stopped based on the monitored result. This structure enhances the accuracy in determining whether the release of engagement of the pinion 14 with the ring gear 22 has been completed or not and is effective in minimizing the wear of the pinion 14. The structure also enables the motor 11 to be stopped immediately after the monitored result is obtained, thus minimizing the required time for which the motor 11 is to be run.

The determination of whether the release of engagement of the pinion 14 with the ring gear 22 has been completed or not may be made by installing an optical or a magnetic sensor near the pinion 14 or the ring gear 22 and monitoring an output from that sensor. Alternatively, a combination of the pinion 14 and the ring gear 22 may be so designed that electricity passes through the pinion 14 and the ring gear 22 upon engagement thereof. When no flow of the electricity through the pinion 14 and the ring gear 22 is found, the ECU 30 determines that the release of engagement of the pinion 14 with the ring gear 22 has been completed. Alternatively, the first solenoid SL1 may also be so designed that the inductance of the coil 18 changes with a change in amount by which the plunger 19 is inserted into the coil 18 (i.e., the position of the pinion 14 in the axial direction thereof). The ECU 33 calculates a stroke of the plunger 19 as a function of a change in inductance of the coil 18 and determines whether the release of engagement of the pinion 14 with the ring gear 22 has been completed or not based on the stroke of the plunger 19.

The motor 11 has electrical characteristics in which output torque is proportional to current supplied thereto. The value of the current flowing through the motor 11 is, therefore, different between when the pinion 14 is rotating in mesh with the ring gear 22 and when the pinion 14 is rotating in disengagement from the ring gear 22. Usually, the value of the current in the former case is greater than that in the latter case. Accordingly, when the value of the current becomes small, the ECU 30 may determine that the release of engagement of the pinion 14 with the ring gear 22 has been completed.

The ECU 30 may be designed to inhibit the rotation of the pinion 14 from being stopped for a period of time between when the pinion 14 is disengaged from the ring gear 22 and when the engine 20 is fired up and starts to run by itself. This structure is operable to bring the pinion 14 into engagement with the ring gear 22 while rotating the pinion 14 to crank the engine 20 again when the engine 20 has failed to continue to run by itself due to, for example, a misfire of an air-fuel mixture in the above period of time, thereby restarting the engine 20 quickly. In the vehicle equipped with the automatic engine stop/restart system, the possibility of a misfire upon restart of the engine 20 after being stopped automatically is usually higher than upon start of the engine 20 in response to turning on of the ignition switch 23. In other words, the possibility that the engine 20 would not be able to continue to run by itself after completion of cranking of the engine 20 is high. The above structure is, therefore, useful in the vehicle equipped with the automatic engine start/restart system.

FIGS. 4(*a*) to 4(*c*) demonstrate operations of the above described modified structure of the engine stop/restart system when it is required to restart the engine 20. FIG. 4(*a*) represents the speed NE of the engine 20. FIG. 4(*b*) represents the on/off state of the first solenoid SL1. FIG. 4(*c*) represents the on/off state of the second solenoid SL2.

When the engine restart condition has been met after the engine 20 is stopped automatically at time t20, the ECU 30 outputs the on-signal to the SL1 drive relay 24 to energize the first solenoid SL1. The pinion 14 is then thrust to the ring gear 22. Afterwards, the ECU 30 outputs the on-signal to the SL2 drive relay 25 at time t21 to energize the second solenoid SL2. The motor 11 is then turned on to rotate the pinion 14, thereby cranking the engine 20.

When the first burning of fuel has occurred in the engine 20, and the speed NE of the engine 20 has been increased above the starting speed NE1 at time t22, the ECU 30 outputs the off-signal to the SL1 drive relay 24 to deenergize the first solenoid SL1. This causes the pinion 14 to be disengaged from the ring gear 22. If the engine 20 is misfired, so that the speed NE of the engine 20 drops before the engine 20 is fired up and continues to be run by combustion of fuel and after completion of the disengagement of the pinion 14 from the ring gear 22, the ECU 30 keeps the motor 11 rotating. At time t23 when the speed NE of the engine 20 has dropped to near the cranking speed, the ECU 30 energizes the first solenoid SL1 to bring the pinion 14 into engagement with the ring gear 22 in the condition where the speed of the pinion 14 is in synchronization with that of the ring gear 22, thereby cranking the engine 20 again. When the speed NE of the engine 20 is elevated above the starting speed NE1 at time t24, the ECU 30 deenergizes the first solenoid SL1 to disengage the pinion 14 from the ring gear 22. At time t25 when the speed NE of the engine 20 reaches the speed NE2 which is used to determine that the engine 20 has been fired up, the ECU 30 stops energizing the second solenoid SL2 to turn off the motor 11.

The ECU 30 may alternatively be designed to stop the motor 11 after instructing the starter 10 to release the engagement of the pinion 14 with the ring gear 33, but before such release is completed actually. This structure also keeps the pinion 14 rotated by the motor 11 for an increased period of time when the pinion 14 is subjected to the rotation of the ring gear 22 as compared with the conventional starters, thus minimizing the wear of the pinion 14.

The engine stop/restart system may alternatively be designed to measure the amount of available electric power remaining in the battery 12 and determine the order of the release of the engagement of the pinion 14 with the ring gear 22 and stop of the motor 11. In terms of reducing the wear of the one-way clutch 15 or the pinion 14, it is preferable that the motor 11 is turned off after the completion of release of engagement of the pinion 14 with the ring gear 22. When the engagement of the pinion 14 with the ring gear 22 is first released, it will result in an increase in time for which the motor 11 is kept energized, which leads to an increase in consumption of electric power from the battery 12. The ECU 30 may, therefore, turn off the motor 11 and then release the engagement of the pinion 14 with the ring gear 22 or perform these operations simultaneously when the amount of electric power remaining in the battery 12 drops below a given value in order to ensure the balance between minimizing the deterioration of the starter 10 and reserving the amount of available electric power in the battery 12.

The engine stop/restart system may alternatively be designed to have a structure which is operable to control the stop of the motor 11 and the release of engagement of the pinion 14 with the ring gear 22 independently from each other without use of the SL1 drive relay 24 which energizes or deenergizes the coil 18 and/or the SL2 drive relay 25 which turns on or off the motor 11. For instance, the engine stop/restart system may have motor-energizing contacts and a motor energization control relay instead of the second solenoid SL2. The motor-energizing contacts are installed on the end of the plunger 19 which is opposite the end thereof joined to the lever 17. The motor energization control relay is disposed between the battery 12 and the motor 11 and works to open or close the motor-energizing contacts in response to an on/off signal from the ECU 30 to turn on or off the motor 11. Specifically, the ECU 30 turns on or off the SL1 drive relay 24 and the motor energization relay independently from each other to control the engagement or disengagement of the pinion 14 with or from the ring gear 22 and the stop of the motor 11 separately.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A starter control apparatus for a starter equipped with a pinion engageable with a ring gear coupled to an output shaft of an engine and a motor operable to rotate the pinion to crank the engine, comprising:

engine operating condition determining means for determining whether the engine has been placed in a condition to continue to run by itself after being cranked by the motor or not; and engagement release means for releasing engagement of the pinion with the ring gear while keeping the pinion rotated by the motor when it is determined by the engine operating condition determining means that the engine has been placed in the condition to continue to run by itself, wherein the starter includes a first solenoid, a first switch, a second solenoid, and a second switch;

the first solenoid has a greater inductance than the second solenoid;

when the starter is turned on, the first solenoid brings the pinion into engagement with the ring gear, the first switch establishes an on-state and an off-state of the first solenoid selectively, the second solenoid works to open or close motor-energizing contacts to establish an off-state or an on-state of the motor, the second switch controls an operation of the second solenoid; and the engagement release means switches the motor from the on-state to the off-state through the second switch to stop rotation of the pinion based on a time required between when the first solenoid is switched from the on-state to the off-state through the first switch and when release of the engagement of the pinion with the ring gear is completed.

2. A starter control apparatus as set forth in claim 1, further comprising pinion rotation stop determining means for determining a time when rotation of the pinion is to be stopped based on a period of time required between when the engagement release means instructs the starter to release the engagement of the pinion with the ring gear and when release of the engagement of the pinion with the ring gear is actually completed.

3. A starter control apparatus as set forth in claim 1, further comprising:

release completion determining means for determining whether release of the engagement of the pinion with the ring gear has been completed or not after the engagement release means instructs the starter to release the engagement of the pinion with the ring gear; and pinion rotation stop determining means for determining a time when rotation of the pinion is to be stopped based a result of a determination of whether the release of the engagement of the pinion with the ring gear has been completed or not.

4. A starter control apparatus as set forth in claim 1, further comprising:

engine-fired up determining means for determining whether the engine has been fired up and started to run by itself or not after the engine starts to be cranked; and pinion stop inhibiting means for inhibiting rotation of the pinion from being stopped until the engine-fired up determining means determines that the engine has been fired up and started to run by itself.

5. A starter control apparatus as set forth in claim 1, further comprising:

pinion stopping time determining means for determining a pinion stopping time that is a time when the motor is to be turned off to stop rotation of the pinion, wherein the engagement release means releases the engagement of the pinion with the ring gear before the pinion stopping time is reached.

* * * * *